US005775484A

United States Patent [19]

Ovadia

[11] Patent Number: 5,775,484

[45] Date of Patent: Jul. 7, 1998

[54] JEWELRY PAD WITH SLIDER ROD

[76] Inventor: Joseph Ovadia, 109 Long Hill Rd., Little Falls, N.J. 07424

[21] Appl. No.: 758,435

[22] Filed: Nov. 29, 1996

[51] Int. Cl.[6] ..... A45C 11/04

[52] U.S. Cl. ..... 206/6.1; 206/560; 206/566

[58] Field of Search ..... 206/6.1, 493, 495, 206/560, 566, 756

[56] References Cited

U.S. PATENT DOCUMENTS

| | | | |
|---|---|---|---|
| 3,351,186 | 11/1967 | Harris | 206/6.1 |
| 3,613,873 | 10/1971 | Schulman . | |
| 4,043,450 | 8/1977 | Rielly | 206/566 |
| 4,300,674 | 11/1981 | Davet | 206/6.1 |
| 4,552,264 | 11/1985 | Quarrell et al. | 206/566 |
| 4,978,001 | 12/1990 | Nelson | 206/6.1 |

*Primary Examiner*—David T. Fidei
*Attorney, Agent, or Firm*—Richard M. Goldberg

[57] ABSTRACT

A jewelry pad for holding jewelry items, includes an upper wall having an upper exposed surface and a concave section with an arch shape in plan view; at least one supporting wall connected to the upper wall for supporting the upper wall on a surface, the at least one supporting wall including substantially parallel side walls connected to side edges of the upper wall, and a rear wall connected to a rear edge of the upper wall; two openings in the upper wall, provided at opposite sides of the upper exposed surface of the concave section; and an elastic and resilient rod adapted to extend through and hold a jewelry item, the rod having opposite ends, each end removably positionable in a respective one of the two openings such that the rod is spaced from the upper exposed surface in order to hold the jewelry item on the upper exposed surface, the rod having a central holding section and opposite end sections, the opposite end sections including the ends removably positionable in the respective ones of the two openings, the central holding section being slightly outwardly bowed, and the opposite end sections being slightly inclined downwardly relative to the central holding section.

17 Claims, 2 Drawing Sheets

JEWELRY PAD WITH SLIDER ROD

BACKGROUND OF THE INVENTION

The present invention relates generally to jewelry pads, and more particularly, is directed to a jewelry pad with a slider rod for displaying jewelry items such as pendants for necklaces.

Conventionally, pendants for necklaces have been displayed with the necklaces, with the necklaces supporting the pendants in the center of the pad. In such case, the bulk of the necklace is wrapped around the pad and positioned behind the pad. This is disadvantageous in that the stock of necklaces required for displaying the pendants is increased. Further, in order to remove the pendant to show a customer, the entire necklace must be removed from the pad, which becomes burdensome when repeated many times.

Although it is known to display pendants separate from the necklaces, the pendants are secured to a pad by a twist pin or a U-pin. A twist pin sticks through the pad and is twisted at the underside of the pad. A U-pin sticks between the foam/fabric layer and the cardboard. However, the twist pin or U-pin creates puncture holes in the jewelry pad, which become unsightly after repeated removal and reapplication of the pin. Also, removal and reapplication of the pins becomes burdensome. In addition, such pins are not operative for large size or unusual shaped pendants, for example, pendants with large bails that can slide through pearl necklaces.

OBJECTS AND SUMMARY OF THE INVENTION

Accordingly, it is an object of the present invention to provide a jewelry pad that overcomes the problems with the aforementioned prior art.

It is another object of the present invention to provide a jewelry pad having a rod that receives the bail of a pendant and which is removably securable to the upper surface of the jewelry pad.

It is still another object of the present invention to provide a jewelry pad in which the rod has bent ends that fit within openings in the upper exposed surface of the jewelry pad and which limit the extent through which the ends of the rod can travel through the jewelry pad, thereby providing a rod of a generally fixed length at the upper exposed surface of the jewelry pad.

It is yet another object of the present invention to provide a jewelry pad in which the rod is elastic and resilient such that the rod is bowed outwardly from the upper exposed surface when fitted on the jewelry pad.

It is a further object of the present invention to provide a jewelry pad in which the upper exposed surface of the jewelry pad has a concave portion for receiving the pendant secured on the rod.

In accordance with an aspect of the present invention, a jewelry pad for holding jewelry items, includes an upper wall having an upper exposed surface; at least one supporting wall for supporting the upper wall on a surface; at least one opening in the upper wall; and a rod adapted to extend through and hold a jewelry item, the rod having opposite ends, at least one end removably positionable in the at least one opening such that the rod is spaced from the upper exposed surface in order to hold the jewelry item on the upper exposed surface.

Preferably, the upper wall has a concave section below the rod, with the concave section having an arch shape in plan view.

The at least one opening includes two openings provided at opposite sides of the upper exposed surface of the concave section.

The rod has a central holding section and opposite end sections, the opposite end sections including the ends removably positionable in the respective ones of the two openings. The central holding section is slightly outwardly bowed, and the opposite end sections are slightly inclined downwardly relative to the central holding section.

The at least one supporting wall includes substantially parallel side walls connected to side edges of the upper wall, and a rear wall connected to a rear edge of the upper wall. The side walls have a substantially triangular configuration and the upper wall is inclined upwardly from a front edge to a rear edge thereof.

In accordance with another aspect of the present invention, a jewelry pad for holding jewelry items, includes an upper wall having an upper exposed surface; at least one supporting wall connected to the upper wall for supporting the upper wall on a surface; two openings in the upper wall; and an elastic and resilient rod adapted to extend through and hold a jewelry item, the rod having opposite ends, each end removably positionable in a respective one of the two openings such that the rod is spaced from the upper exposed surface in order to hold the jewelry item on the upper exposed surface.

In accordance with still another aspect of the present invention, a jewelry pad for holding jewelry items, includes an upper wall; at least one supporting wall connected to the upper wall for supporting the upper wall on a surface; a concave section in the upper wall and having an upper exposed surface; and two openings provided at opposite sides of the upper exposed surface of the concave section for receiving a necklace chain therethrough.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
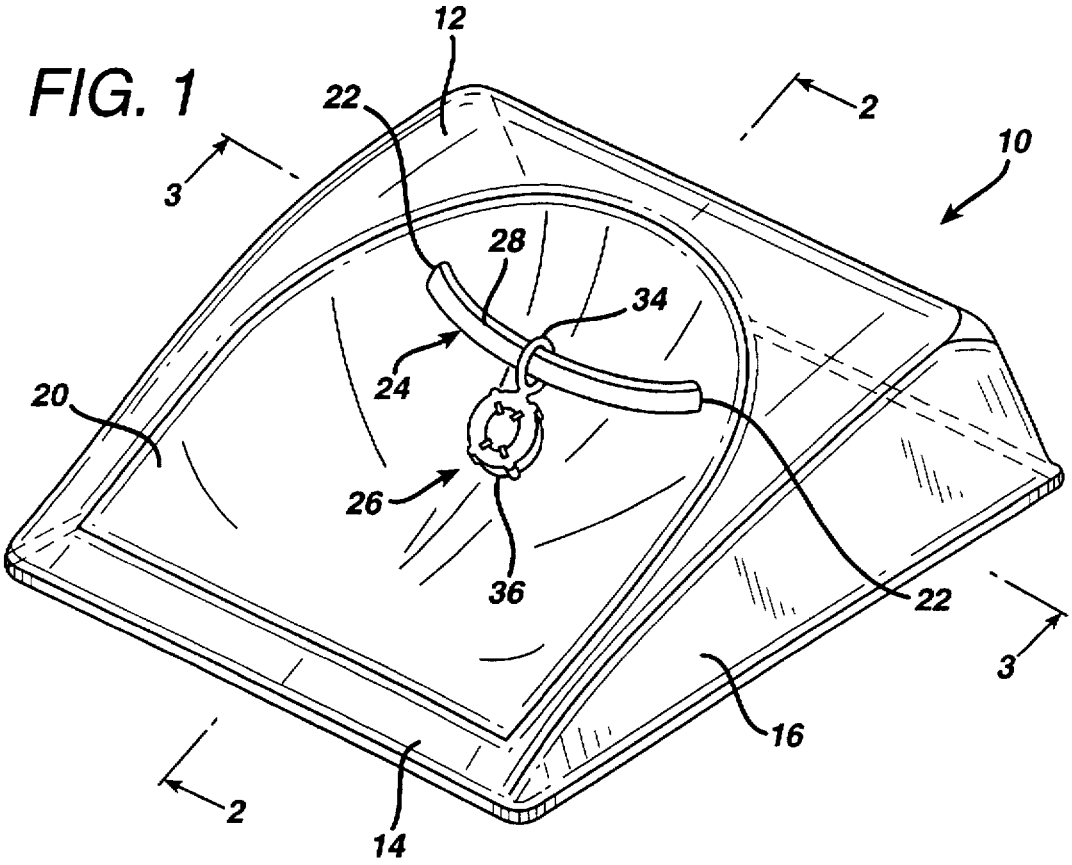
FIG. 1 is a perspective view of a jewelry pad according to the present invention, showing a pendant held thereon.
Figure 2:
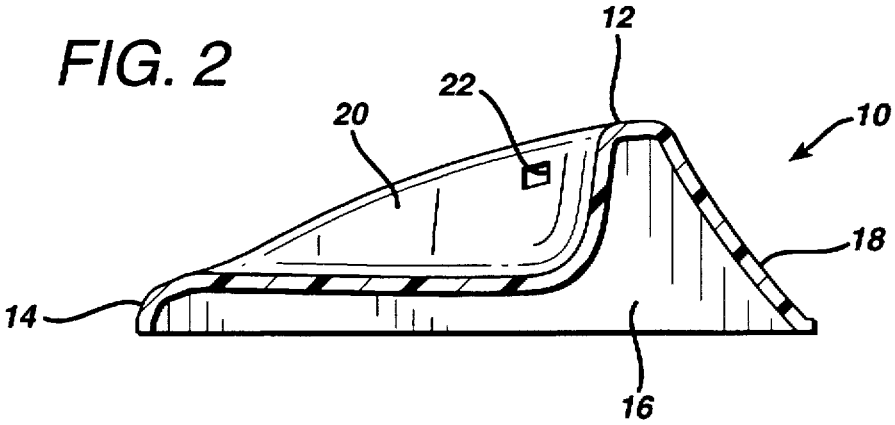
FIG. 2 is a cross-sectional view of the jewelry pad of FIG. 1, taken along line 2—2 thereof, with the rod removed.
Figure 3:
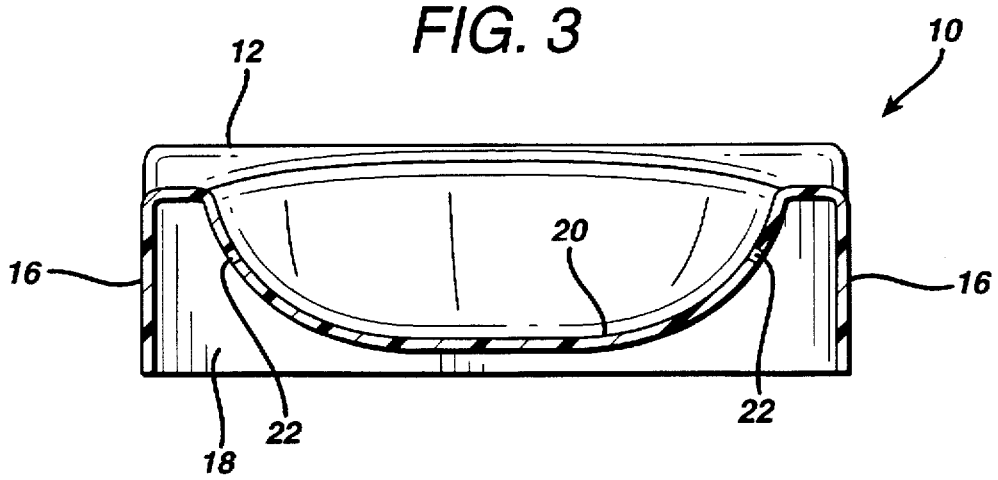
FIG. 3 is a cross-sectional view of the jewelry pad of FIG. 1, taken along line 3—3 thereof, with the rod removed.

Referring to the drawings in detail, a deformable and resilient jewelry pad 10 according to one embodiment of the present invention includes a substantially rectangular upper inclined wall 12 that extends upwardly and rearwardly from the upper edge of a short front wall 14 at an inclination of about 20° to the ground surface. Inclined wall 12 can have a slightly convex bowed configuration from its front edge to its rear edge. Side walls 16 of a substantially triangular configuration have their upper inclined edges connected with respective side edges of upper inclined wall 12. A substantially rectangular rear wall 18 has its upper edge connected with the rear edge of upper inclined wall 12 and its opposite side edges connected to the rear edges of triangular side walls 16. Rear wall 18 may be inclined rearwardly and downwardly at an inclination of, for example, about 15°. With this arrangement, the lower edges of front wall 14, side walls 16 and rear wall 18 lie in the same horizontal plane and support pad 10 on a flat surface.

Figure 4:
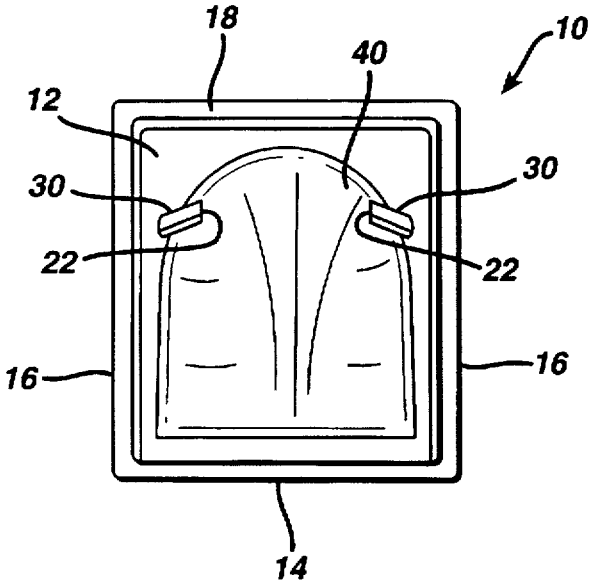
FIG. 4 is a bottom plan view of the jewelry pad.

Upper surface 12 further includes a concave section 20 which is sufficiently deep such that the lowest portion thereof extends down to a position slightly higher than the ground surface when pad 10 is situated thereon, although concave section 20 can also touch the ground in such case. As shown in FIGS. 1 and 4, concave section 20 preferably has an arch shape in plan view, although the present invention is not so limited. In addition, concave section 20 is shown to occupy a major portion of upper inclined wall 12, although the size thereof can also vary within the scope of the present invention.

Each pad 10 is adapted to fit within a recess of a jewelry tray or box (not shown), as is well-known, and is held therein. In this regard, although the dimensions of jewelry pad 10 can vary, a substantially actual size of one of many preferred sizes of jewelry pads is shown in FIG. 4.

Preferably, each pad 10 is made from a flexible and resilient plastic material that can be deformed but which retains its shape when the deformation force is removed. Alternatively, pad 10 can be made of a rubber or any other suitable material. In any event, pad 10 is made of a high memory material with a substantially thin, constant thickness throughout. Because pad 10 has a substantially constant thickness throughout, it is thin and therefore easily deformable, while reducing the amount of material that is used.

Thus, each pad 10 is formed as a single, unitary plastic molded part, although it is also possible to provide a fabric material or flocked layer thereon.

Specifically, unlike conventional jewelry pads, each pad 10 is formed in an injection molding operation, using pellets of an injection molding material, such as polypropylene, olefinic materials, polyurethane and other synthetic rubber, plastic rubber or flexible materials. An example of such a material is one sold under the trademark "KRATON". Thus, the pellets are placed in a conduit leading to a space between two molded halves. The pellets are heated to liquefy the same, and the liquid is forced under pressure to a space between the two closed mold halves to form the jewelry pad. Then, the mold is cooled, and the mold halves are separated, in order to remove the formed jewelry pad therefrom. Injection molded rubbery pads 10 are flexible and do not lose memory.

However, the present invention is not limited to a flexible and resilient material, but can be made of a rigid material, or only slightly resilient material.

In accordance with the present invention, two openings 22 are formed in upper inclined wall 12 of jewelry pad 10, and more preferably, at opposite sides at the upper portion of concave section 20. Alternatively, a recess or indentation can be used in place of openings 22. For purpose of the claims herein, reference to an "opening" will refer to a partial opening such as a recess as well as a through opening.

Figure 5:
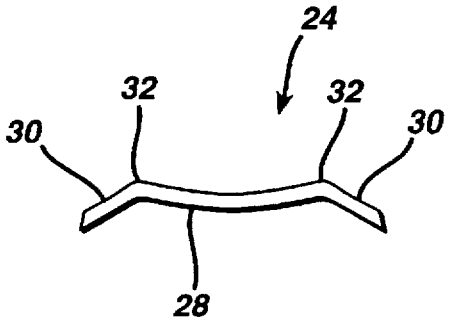
FIG. 5 is a front elevational view of the rod.
Figure 6:
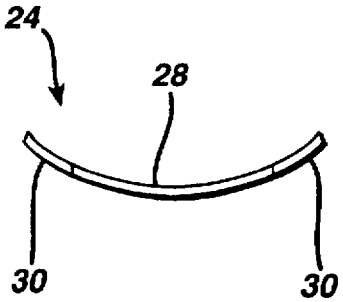
FIG. 6 is a top plan view of the rod.

A rod 24, which is preferably elastic and resilient, is adapted to extend through openings 22 in order to hold a jewelry item 26 thereon. Alternatively, rod 24 can be rigid. As shown best in FIGS. 1, 5 and 6, rod 24 has a central holding section 28 of a slightly bowed configuration, with opposite, slightly downturned insertable end sections 30 which are adapted to be inserted through openings 22. End sections 30 are preferably downturned by an angle of about 35°. Rod 24 is preferably made of the same elastic and resilient material as jewelry pad 10. However, unlike straps, rod 24 holds a specific shape when no external force is applied thereto, this shape being shown in FIGS. 5 and 6.

As shown in FIG. 1, end sections 30 of rod 24 are inserted within openings 22. In such case, the junctions 32 between central holding section 28 and end sections 30 form a distinct angle which functions as a stop to prevent central holding section 28 from being inserted further through openings 22, and thereby effectively fixing the length of rod 24 that is exposed to the length of central holding section 28.

However, other stop means can be used. For example, end sections 30 can be formed as continuations of section 28 without any bends. In such case, end sections 30 and openings 22 can be made smaller than section 28 to form a stop.

With this arrangement, rod 24 is easily and readily removable from openings 22. In such case, the bail 34 of a jewelry item 26, such as a pendant, can receive rod 24 therethrough such that bail 34 is positioned centrally of central holding section 28. Thus, bail 34 can slide along central holding section 28. Then, end portions 30 of rod 24 are inserted through openings 22 such that central holding section 28 presents a slightly bowed shape which is spaced from the upper exposed surface of concave section 20. However, it will be appreciated that section 28 can be configured to be linear or assume any other shape when held on pad 10. As a result, the jewelry portion 36 of pendant 26 will rest on the upper exposed surface of concave section 20. Because bail 34 is held by central holding section 28 and thereby raised above the upper exposed surface of concave section 20, jewelry portion 36 will be slightly inclined downwardly so as to provide a good presentation thereof on jewelry pad 10.

In order to remove jewelry item 26, it is only necessary to remove opposite end portions 30 of rod 24 from openings 22, and slide rod 24 out from bail 34. In such case, the pendant can be shown to a customer and can then be easily and readily reinserted on rod 28.

It will therefore be appreciated that the present invention provides a novel display of a pendant on a jewelry pad in an easily and ready manner.

In addition, although not shown, more than one pendant can be inserted on rod 24.

The present invention is not limited to the display of pendants. For example, the present invention can be used for the display of earrings for non-pierced ears and other jewelry items.

Further, although concave section 20 is provided to better display jewelry item 26, it will be appreciated that concave section 20 can be eliminated such that upper inclined wall 12 is provided in a common inclined plane. In such case, upper wall need not be inclined, but can be relatively flat, for example, as in U.S. Pat. No. 4,432,456 having one common inventor herewith.

As another modification, a single large jewelry pad can be provided with multiple openings 22 and rods 24.

As a further modification, rod 24 can be eliminated, and instead, the necklace chain can be inserted through openings 22 such that pendant 26 is held on the necklace chain and displayed on concave section 20.

As a still further modification, one opening 22 can be eliminated, with one end of rod 24 fixedly secured to the pad at the position of the removed opening. For example, glue 40 can be used to secure one end of rod 24, as shown by dashed lines in FIG. 4. Thus, only the opposite end section 30 of rod 24 would be removable from a single opening 22 in the pad.

Having described a specific preferred embodiment of the invention with reference to the accompanying drawings, it will be appreciated that the present invention is not limited to that precise embodiment, and that various changes and modifications can be effected therein by one of ordinary skill in the art without departing from the scope or spirit of the invention as defined by the appended claims.

What is claimed is:

1. A jewelry pad for holding jewelry items, comprising:

an upper wall having an upper exposed surface on which at least one said jewelry item is held;

at least one supporting wall for supporting the upper wall on a surface;

at least one opening in said upper exposed surface of said upper wall; and a rod removably extending into said at least one opening in said upper exposed surface to hold at least one said jewelry item on said rod such that said at least one jewelry item rests on said upper exposed surface, said rod having opposite ends, at least one end removably positionable in said at least one opening such that said rod is spaced from said upper exposed surface in order to hold said jewelry item on said upper exposed surface and said rod being exposed and viewable above said upper exposed surface.

2. A jewelry pad according to claim 1, wherein said upper wall has a concave section below said rod.

3. A jewelry pad according to claim 2, wherein said concave section has an arch shape in plan view.

4. A jewelry pad according to claim 2, wherein said at least one opening includes two openings provided at opposite sides of the upper exposed surface of said concave section.

5. A jewelry pad according to claim 1, wherein said rod has a central holding section between said opposite ends, and said central holding section is slightly outwardly bowed.

6. A jewelry pad for holding jewelry items, comprising:

an upper wall having an upper exposed surface;

at least one supporting wall for supporting the upper wall on a surface;

at least one opening in said upper wall; and a rod adapted to extend through and hold a jewelry item, said rod having opposite ends, at least one end removably positionable in said at least one opening such that said rod is spaced from said upper exposed surface in order to hold said jewelry item on said upper exposed surface, and said rod has a central holding section between said opposite ends, and said opposite ends are slightly inclined downwardly relative to said central holding section.

7. A jewelry pad according to claim 1, wherein said at least one supporting wall includes substantially parallel side walls connected to side edges of said upper wall, and a rear wall connected to a rear edge of said upper wall.

8. A jewelry pad according to claim 1, wherein one end of said rod is fixedly secured to said jewelry pad.

9. A jewelry pad according to claim 1, wherein said rod is made from an elastic and resilient material.

10. A jewelry pad for holding jewelry items, comprising:

an upper wall having an upper exposed surface on which at least one said jewelry item is held;

at least one supporting wall connected to the upper wall for supporting the upper wall on a surface;

two openings in said upper exposed surface of said upper wall; and an elastic and resilient rod removably extending into said two openings in said upper exposed surface to hold a jewelry item on said rod such that said at least one jewelry item rests on said upper exposed surface, said rod having opposite ends, each end removably positionable in a respective one of said two openings such that said rod is spaced from said upper exposed surface in order to hold said jewelry item on said upper exposed surface and said rod being exposed and viewable above said upper exposed surface.

11. A jewelry pad according to claim 10, wherein said upper wall has a concave section below said jewelry item.

12. A jewelry pad according to claim 11, wherein said concave section has an arch shape in plan view.

13. A jewelry pad according to claim 11, wherein said two openings are provided at opposite sides of the upper exposed surface of said concave section.

14. A jewelry pad according to claim 10, wherein said rod has a central holding section and opposite end sections, said opposite end sections including said ends removably positionable in the respective ones of said two openings.

15. A jewelry pad for holding jewelry items, comprising:

an upper wall having an upper exposed surface;

at least one supporting wall connected to the upper wall for supporting the upper wall on a surface;

two openings in said upper wall; and an elastic and resilient rod adapted to extend through and hold a jewelry item, said rod having opposite ends, each end removably positionable in a respective one of said two openings such that said rod is spaced from said upper exposed surface in order to hold said jewelry item on said upper exposed surface, said rod has a central holding section and opposite end sections, said opposite end sections including said ends removably positionable in the respective ones of said two openings, and said central holding section is slightly outwardly bowed.

16. A jewelry pad according to claim 14, wherein said opposite end sections are slightly inclined downwardly relative to said central holding section.

17. A jewelry pad according to claim 10, wherein said at least one supporting wall includes substantially parallel side walls connected to side edges of said upper wall, and a rear wall connected to a rear edge of said upper wall.

* * * * *